US011703249B2

(12) United States Patent
Puranen et al.

(10) Patent No.: US 11,703,249 B2
(45) Date of Patent: Jul. 18, 2023

(54) LINEARIZATION OF AIRFLOW THROUGH ZONE DAMPERS OF AN HVAC SYSTEM

(71) Applicant: Rheem Manufacturing Company, Atlanta, GA (US)

(72) Inventors: Christopher M. Puranen, Montgomery, AL (US); Stephen Maciulewicz, Montgomery, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 0 days.

(21) Appl. No.: 17/750,259

(22) Filed: May 20, 2022

(65) Prior Publication Data

US 2022/0275962 A1 Sep. 1, 2022

Related U.S. Application Data

(63) Continuation of application No. 16/866,032, filed on May 4, 2020, now Pat. No. 11,339,991, which is a continuation of application No. 15/850,609, filed on Dec. 21, 2017, now Pat. No. 10,641,515.

(51) Int. Cl.

| | |
|---|---|
| ***F24F 11/74*** | (2018.01) |
| ***F24F 3/052*** | (2006.01) |
| ***F24F 11/62*** | (2018.01) |
| ***F24F 3/044*** | (2006.01) |
| ***F24F 140/40*** | (2018.01) |
| ***F24F 110/40*** | (2018.01) |

(52) U.S. Cl.

CPC ..... *F24F 11/74* (2018.01); *F24F 3/044* (2013.01); *F24F 3/0527* (2013.01); *F24F 11/62* (2018.01); *F24F 2110/40* (2018.01); *F24F 2140/40* (2018.01)

(58) Field of Classification Search

CPC ..... F24F 11/74; F24F 3/044; F24F 3/0527; F24F 11/62; F24F 2110/40; F24F 2140/40

See application file for complete search history.

(56) References Cited

U.S. PATENT DOCUMENTS

| | | | | |
|---|---|---|---|---|
| 4,995,307 | A | 2/1991 | Floyd | |
| 5,435,779 | A | 7/1995 | Sharp et al. | |
| 5,730,652 | A | 3/1998 | Van Becelaere | |
| 7,017,827 | B2 | 3/2006 | Shah et al. | |
| 7,891,573 | B2 | 2/2011 | Finkam et al. | |
| 2003/0104778 | A1* | 6/2003 | Liu | F24F 11/0001 454/61 |

(Continued)

*Primary Examiner* — Nelson J Nieves

(74) *Attorney, Agent, or Firm* — Eversheds Sutherland (US) LLP

(57) ABSTRACT

A control system can provide a linear behavior of airflow as a function of damper position of each zone damper in an HVAC system. The control system incrementally closes each zone damper from a fully open position to a fully closed position, and records static pressure measurements with each change in damper position. Then, using a mathematical model that is derived from the second fan law, a correction is calculated for each damper position of each zone damper based on the recorded static pressure measurements to provide corrected damper positions at which the airflow through the zone damper exhibits a linear behavior. The corrected damper positions are stored and used during an operational cycle of the HVAC system to obtain a precise airflow through the zone dampers.

18 Claims, 5 Drawing Sheets

(56) References Cited

U.S. PATENT DOCUMENTS

| | | | |
|---|---|---|---|
| 2008/0119126 | A1 | 5/2008 | Shizuo et al. |
| 2012/0322358 | A1 | 12/2012 | Wendorski et al. |
| 2014/0106660 | A1 | 4/2014 | Salerno |
| 2015/0107817 | A1 | 4/2015 | Douglas |
| 2016/0025764 | A1 | 1/2016 | Semat et al. |
| 2016/0161139 | A1 | 6/2016 | Asmus et al. |
| 2017/0122611 | A1 | 5/2017 | Nilsson |
| 2019/0203971 | A1 | 7/2019 | Iio et al. |
| 2020/0224903 | A1 | 7/2020 | Johnson |

* cited by examiner

LINEARIZATION OF AIRFLOW THROUGH ZONE DAMPERS OF AN HVAC SYSTEM

TECHNICAL FIELD

The present disclosure relates generally to temperature control systems, and more particularly to linearization of airflow through zone dampers of a heating, ventilating, and air-conditioning (HVAC) system.

BACKGROUND

Temperature control systems, such as multi-zone HVAC systems (hereinafter 'HVAC system') include one or more components to condition air that enters the system and drive the conditioned air through supply ducts to multiple zones within a building. Each supply duct includes zone dampers that may be adjusted to control a flow of the conditioned air into each zone to achieve a desired temperature within the zone. Some zone dampers, such as modulating zone dampers, may include intermediate positions between a fully open position and a fully closed position such that the zone dampers can be incrementally closed to achieve a desired flow of the conditioned air in a zone. The number of available intermediate positions may vary based on a desired granularity in controlling the flow of the conditioned air to the zone.

Conventional HVAC systems operate under the assumption that the relationship between a change in the damper positions of the zone dampers of the HVAC system and the volume of conditioned air flowing through the zone dampers is a linear relationship. The linear relationship between the flow of the conditioned air (hereinafter 'airflow') with each change in damper position of the zone damper is desired for obtaining the best performance in the HVAC system. However, typically, most zone dampers exhibit nonlinear behavior of airflow with the change in damper positions of the zone damper, which in turn causes rough and uneven changes in temperature and airflow, excess airflow noise, and/or inadequate conditioning of the zone. The nonlinear behavior of the airflow may also cause the HVAC system to suffer from unexpected perturbations and even go out of control.

In light of the above mentioned shortcomings of conventional HVAC systems, zone dampers that exhibit a linear behavior of airflow through the zone dampers for each damper position are described herein. It is noted that this background information is provided to reveal information believed by the applicant to be of possible relevance to the present disclosure. No admission is necessarily intended, nor should be construed, that any of the preceding information constitutes prior art against the present disclosure.

SUMMARY

In one aspect, the present disclosure relates to a control system to obtain a linear behavior of airflow through a zone damper of a zone of an HVAC system with a change in damper positions of the zone damper. The control system includes an air handler that is configured to deliver the airflow through the HVAC system. The control system further includes the zone damper that is configured to adjust the airflow to the zone of the HVAC system, wherein the damper positions of the zone damper comprises at least one intermediate position between a fully open position and a fully closed position. Furthermore, the control system includes a system controller that is coupled to the air handler and the zone damper. The system controller is configured to instruct the air handler to maintain a fixed airflow through the HVAC system. Further, while maintaining a fixed airflow through the HVAC system, the system controller is configured to record a static pressure across the HVAC system when the zone damper is in: (a) the fully open position, (b) the at least one intermediate position, and (c) the fully closed position. Furthermore, the system controller is configured to determine a corrected intermediate position by applying a correction to the at least one intermediate position for obtaining the linear behavior of airflow through the zone damper. The corrected intermediate position is determined based on the static pressure when the zone damper is in the fully open position, the static pressure when the zone damper is in the at least one intermediate position, and the static pressure when the zone damper is in the fully closed position. The system controller is configured to store the corrected intermediate position in a memory of the system controller. The corrected intermediate position that is stored in the memory of the system controller is used to adjust a position of the zone damper during an operational phase of an HVAC system.

In another aspect, the present disclosure relates to a system controller of an HVAC system. The system controller includes a processor, and a memory that comprises instructions for obtaining a linear behavior of airflow through a zone damper of a zone of the HVAC system with a change in damper positions of the zone damper. When the instructions are executed by the processor, the instructions cause the processor to control an air handler of the HVAC system to maintain a fixed airflow through the HVAC system, and turn off one or more temperature control elements of the HVAC system. Further, for each zone damper, the instructions cause the processor to control incrementally close the zone damper by sequentially progressing the zone damper through a plurality of intermediate positions between a fully open position and a fully closed position. Furthermore, for each intermediate position of the zone damper, the instructions cause the processor to record a static pressure across the HVAC system when the zone damper is in: (a) the fully open position, (b) the intermediate position, and (c) the fully closed position; determine a corrected position associated with the intermediate position for obtaining the linear behavior of airflow through the zone damper, and store the corrected position in the memory of the system controller, wherein the system controller uses the corrected position that is stored in the memory to adjust a damper position of the zone damper during an operational phase of an HVAC system. The corrected position is calculated using a mathematical model comprising the following mathematical equations:

$$\text{Corrected damper position_}n=(\text{Damper position_}n-(1-\text{Correction percent_}n)*(\text{Damper position_}n-\text{Damper position_}(n+1))),$$

$$\text{Correction percent_}n=((Kn\text{_ideal}-K\text{_}(n+1)))/((Kn-K\text{_}(n+1))), \text{ and}$$

$$Kn=((1-\sqrt{(SP\text{_position}(n)/(SP\text{_zone closed}))})/(1-\sqrt{(SP\text{_open}/(SP\text{_zone closed}))})),$$

where SP_position is a value of the static pressure across the HVAC system when the zone damper is the intermediate position, SP_zone closed is a value of the static pressure across the HVAC system when the zone damper is in the fully closed position, SP_open is a value of the static pressure across the HVAC system when the zone damper is in the fully open position, Kn_ideal is the value of a system constant associated with the intermediate position in an ideal system with the linear behavior, Kn is a value of the system constant that is calculated based on the values of the static pressure when the zone damper is in the fully open position, the intermediate position, and the fully closed position, K_(n+1) is a value of a system constant associated with a damper position of the zone damper that sequentially follows the intermediate position, Damper position_n is the intermediate position of the zone damper, and Damper position_(n+1) is the damper position of the zone damper that sequentially follows the intermediate position.

In yet another aspect, the present disclosure relates to a method of a control system for obtaining linear behavior of airflow through a zone damper of a zone of an HVAC system with a change in damper positions of the zone damper. The method includes instructing an air handler of the HVAC system to maintain a fixed airflow through the HVAC system. Further, while maintaining a fixed airflow through the HVAC system, the method includes recording a static pressure across the HVAC system when the zone damper is in: (a) a fully open position, (b) an intermediate position between the fully open position and a fully closed position, and (c) the fully closed position. Furthermore, the method includes determining a corrected intermediate position by applying a correction to the intermediate position for obtaining the linear behavior of airflow through the zone damper. The corrected intermediate position is determined using a mathematical model that is derived from a second fan law and based on the static pressure when the zone damper is in the fully open position, the static pressure when the zone damper is in the intermediate position, and the static pressure when the zone damper is in the fully closed position. The method includes storing the corrected intermediate position in a memory associated with the control system, wherein the corrected intermediate position that is stored in the memory is used to adjust a position of the zone damper during an operational phase of an HVAC system.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
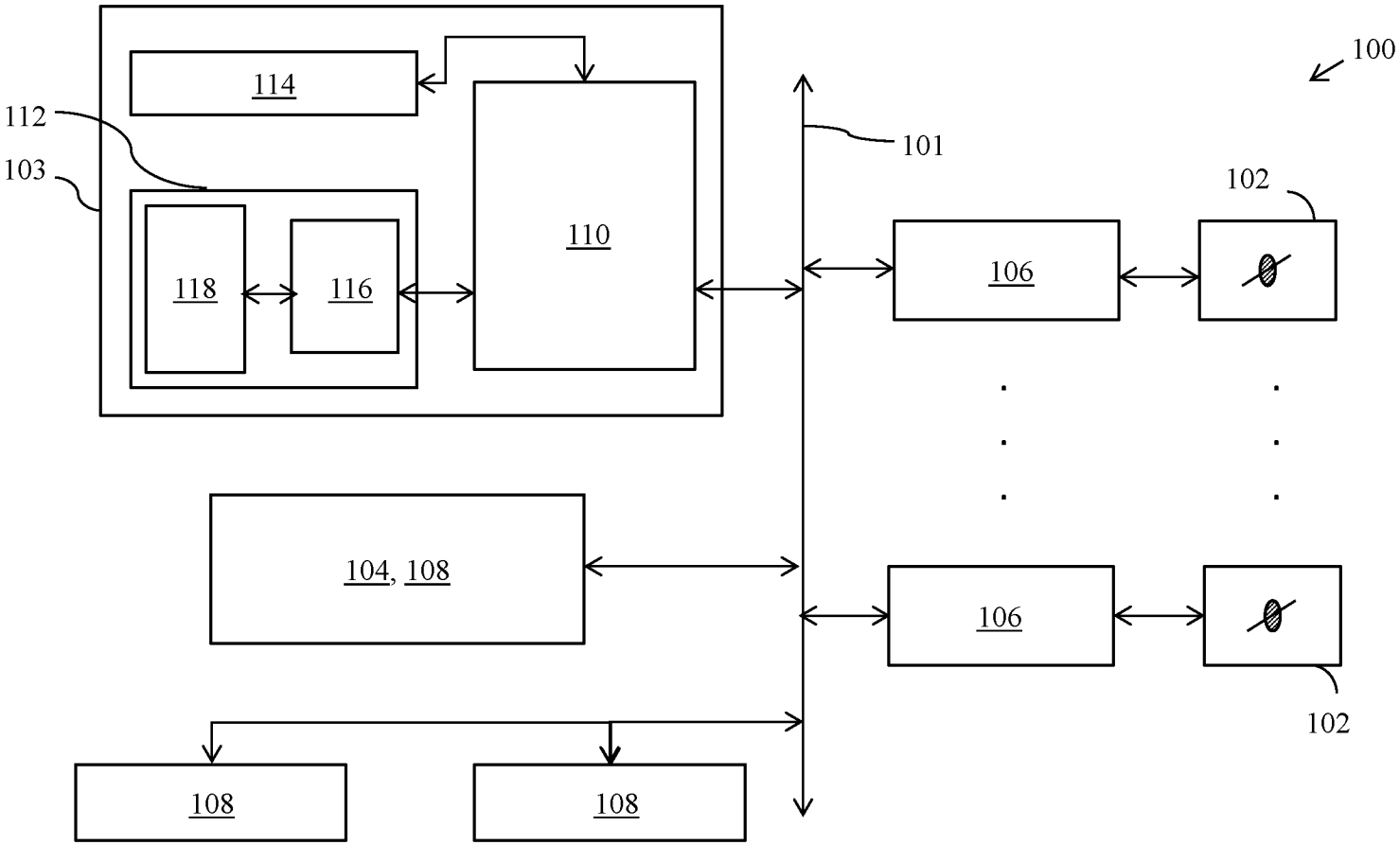
FIG. 1 is an example control system of an HVAC system, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION OF EXAMPLE EMBODIMENTS

The present disclosure describes a system and method to provide a linear behavior of airflow as a function of damper position of each zone damper in an HVAC system. Each zone damper of the HVAC system is incrementally closed from a fully open position to a fully closed position and static pressure measurements are recorded with each change in damper position. Then, using a mathematical model that is derived from the second fan law, a correction is calculated for each damper position of each zone damper based on the static pressure measurements to provide corrected damper positions at which the airflow through the zone damper exhibits a linear behavior. The corrected damper positions are stored. Further, during an operational cycle of the HVAC system, the corrected damper positions are applied to the zone dampers to obtain a precise airflow through the zone dampers, which in turn results in smooth temperature changes and control in a zone, as well as smooth airflow noise changes in the zone. The term 'static pressure' as used herein may generally refer to an external static pressure.

Conventional HVAC systems operate under the assumption of a linear relationship of airflow through a zone damper with each change in damper position. However, in reality the zone dampers exhibit nonlinear behavior of airflow with the change in damper positions of the zone damper. This in turn may result in control inaccuracies which affects the overall performance and control of the HVAC system. For example, in said conventional systems that assume linear airflow behavior, when there is a requirement to deliver a 20% airflow to a zone, the zone dampers of the zone may be opened by 20%. However, because of the nonlinear behavior of the airflow, the airflow through the zone may not be 20%. That is, the airflow through the zone may be more than 20%, e.g., 40%, or may be less than 20%, e.g., 5%, which in turn may cause the zone to be over-conditioned or under-conditioned. Further, the balance of airflow and pressures (e.g., static pressures) in the HVAC system may be affected and one or more zones may experience excess airflow noise and other control and performance issues. Therefore, to obtain the best performance and precise control of the HVAC system, it is desirable to correct for the nonlinearity of airflow with a change in the damper positions of a zone damper.

Example embodiments of the HVAC system and method of the present disclosure will be described more fully hereinafter with reference to the accompanying drawings that describe representative embodiments of the present technology. If a component of a figure is described but not expressly shown or labeled in that figure, the label used for a corresponding component in another figure can be inferred to that component. Conversely, if a component in a figure is labeled but not described, the description for such component can be substantially the same as the description for a corresponding component in another figure. Further, a statement that a particular embodiment (e.g., as shown in a figure herein) does not have a particular feature or component does not mean, unless expressly stated, that such embodiment is not capable of having such feature or component. For example, for purposes of present or future claims herein, a feature or component that is described as not being included in an example embodiment shown in one or more particular drawings is capable of being included in one or more claims that correspond to such one or more particular drawings herein.

The technology of the HVAC system and method of the present disclosure may be embodied in many different forms and should not be construed as limited to the embodiments set forth herein; rather, these embodiments are provided so that this disclosure will be thorough and complete, and will fully convey the scope of the technology to those appropriately skilled in the art. Further, example embodiments of the present disclosure can be located in any type of environment (e.g., warehouse, attic, garage, storage, mechanical room, basement) for any type (e.g., commercial, residential, industrial) of user.

Terms such as "first", "second", "third", and "within", etc., are used merely to distinguish one component (or part of a component or state of a component) from another. Such terms are not meant to denote a preference or a particular orientation, and are not meant to limit embodiments of HVAC systems and methods of the present disclosure. In the following detailed description of the example embodiments, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Turning now to the figures, example embodiments of an HVAC system will be described in connection with FIGS. 1-5. In particular, a control system of an HVAC system of the present disclosure will be described in connection with FIG. 1; example operations of the HVAC system for correcting a nonlinear behavior of airflow as a function of zone damper position of the zone dampers in the HVAC system will be described in connection with FIGS. 2-4; and an example system controller of the control system will be described in in connection with FIG. 5.

Turning to FIG. 1, an example HVAC system 100 may include an air handler 103 that takes air from return ducts and drives the air into a plurality of supply ducts associated with distinct zones of a building. Each supply duct may include a zone damper 102 that may be controlled by a system controller 104 to restrict or allow flow of air into each zone to achieve a desired temperature. In particular, each zone may include a zone panel 106 that may be coupled to the system controller 104 and the respective zone damper 102. In one example embodiment, the zone panel 106 may be a simple input/output device that may be configured to adjust the damper position of the zone damper 102 based on control signals received from the system controller 104. However, in other example embodiments, the zone panel 106 may be an intelligent device that may be configured to process information, make decisions, and perform control operations.

The zone damper 102 may be a modulating damper that has one or more damper blades that may be incrementally closed. In other words, the zone damper may have several intermediate positions between a fully open position and a fully closed position. In the example embodiment of the present disclosure, the zone damper 102 may include six intermediate angular positions (herein 'intermediate positions') between the fully open position and a fully closed position. That is, the zone damper 102 may have a total of eight positions, where the first position may be an open position and the eighth position may be a closed position or vice-versa. However, one of skill in the art can understand and appreciate that in other example embodiments, the zone damper 102 may have fewer or more incremental positions between the fully open position and a fully closed position without departing from a broader scope of the present disclosure. Further, even though FIG. 1 illustrates each zone having a single zone damper 102, one of skill in the art can understand and appreciate that in other example embodiments, each zone may have a plurality of zone dampers that are coupled together and configured to operate in concert to provide the necessary airflow to the respective zone.

As illustrated in FIG. 1, the system controller 104 may be coupled to the zone panels 106 of the different zones, the thermostats 108 associated with each zone, and the air handler 103 through a data communication bus 101 of a communication system of the HVAC system 100, such as Rheem EcoNet™. In particular, with respect to the air handler 103, the system controller 104 may be coupled to an air handler controller 110 that transmits air handler data to the system controller 104 and receives data from the system controller 104. The air handler controller 110 may be configured to control a functioning of the air handler 103 in general, and/or a functioning of the different components of the air handler 103, such as, the blower assembly 112 and the temperature control elements 114 (heating and/or cooling coils). The air handler controller 110 may be coupled to a motor 116 of the blower assembly 112 and configured to control the motor 116 based on operational requests received from the system controller 104 and/or the thermostats 108. The motor 116 is configured to control the blades of a fan 118 to move air through the supply ducts and into the zones of the HVAC system 100 based on the operational requests. Preferably, the motor 116 may be an electronically commutated motor (ECM) and the blower assembly 112 may be a variable speed blower assembly.

In one example embodiment, the system controller 104 may be any one of the thermostats 108 of the HVAC system. For example, a thermostat associated with a first zone may be configured to operate as the system controller 104. Alternatively, in another example, a thermostat associated with the main or largest zone may be configured to operate as the system controller 104. In other example embodiments, the system controller 104 may be a dedicated control device that is distinct from and communicatively coupled to the thermostats 108 of the different zones. In either case, the system controller 104 is configured to receive information of all the zones from the respective thermostats 108 and control the zone dampers of each zone through the respective zone panels to adjust an airflow to the respective zones. Further, the system controller 104 is configured to calculate corrections for the intermediate positions of the zone dampers 102 of the HVAC system 100 in order to achieve linear behavior of airflow with a change in the damper positions of the zone dampers 102.

One of ordinary skill in the art can understand and appreciate that in addition to the components described above, the HVAC system 100 may include many other additional components such as filters, bypass ducts, etc. However, said additional components are not described herein to avoid obscuring the features that are associated with linearizing airflow through the zone dampers 102 of the HVAC system 100.

An example operation of the system controller 104 of the HVAC system 100 to linearize the airflow through the zone dampers for the intermediate positions of the zone dampers will be described below in greater detail in association with FIGS. 2-4.

Figure 2:
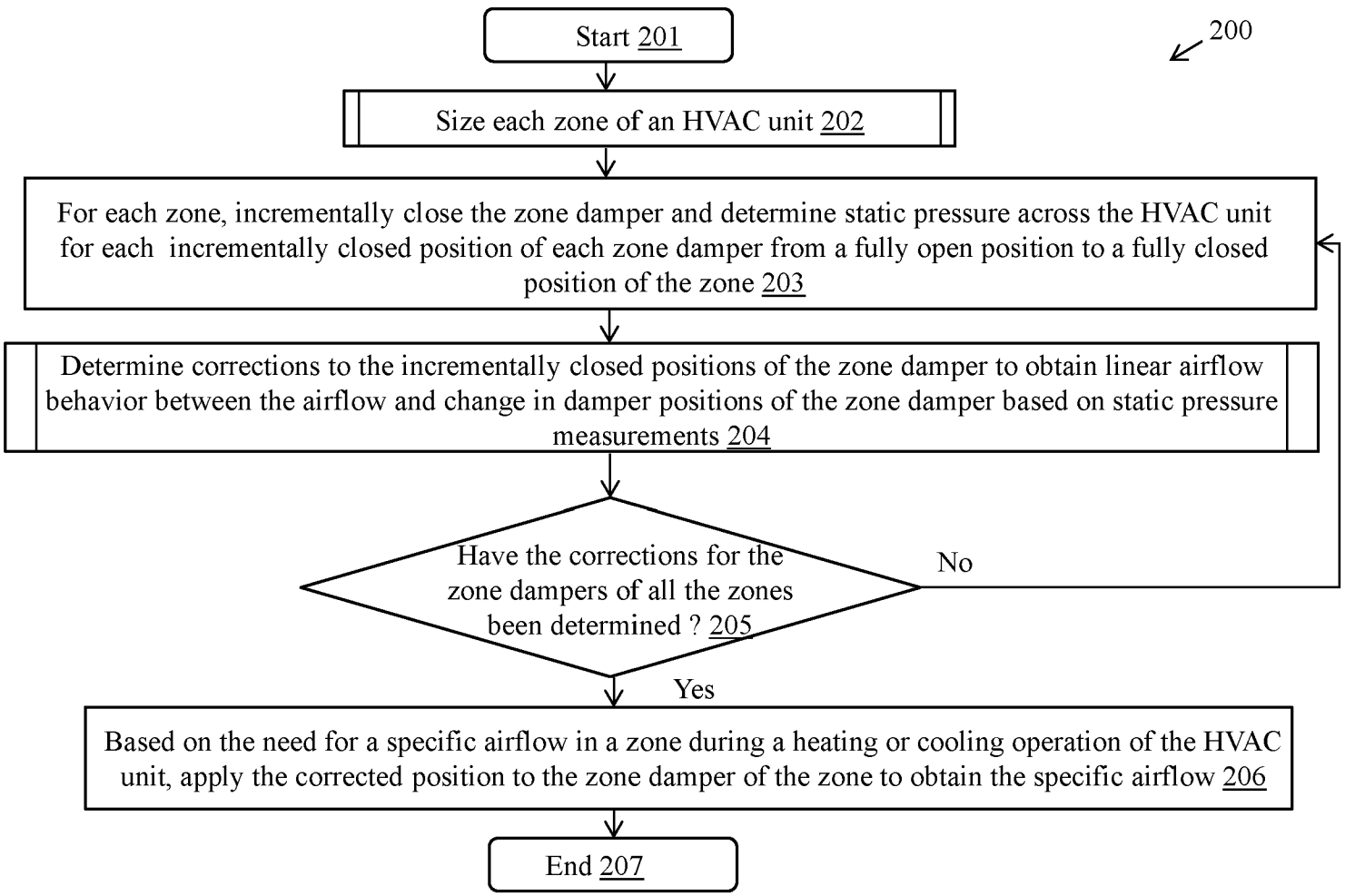
FIG. 2 is a flowchart illustrating an example method of correcting a nonlinear behavior of airflow as a function of zone damper position of the zone dampers in the HVAC system, in accordance with example embodiments of the present disclosure.
Figure 3:
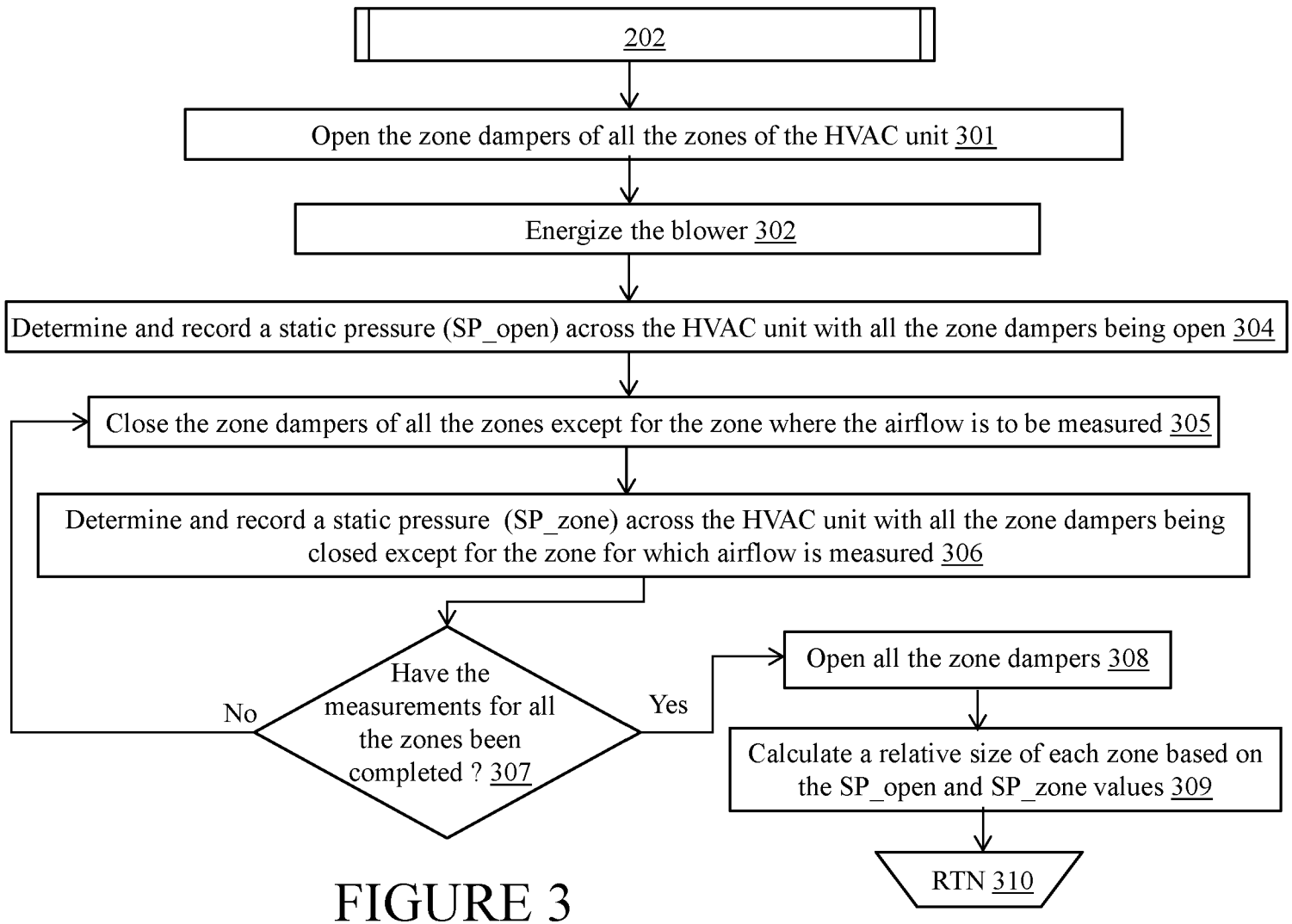
FIG. 3 is flowchart illustrating an example method of sizing the zones of the HVAC system, in accordance with example embodiments of the present disclosure.
Figure 4:
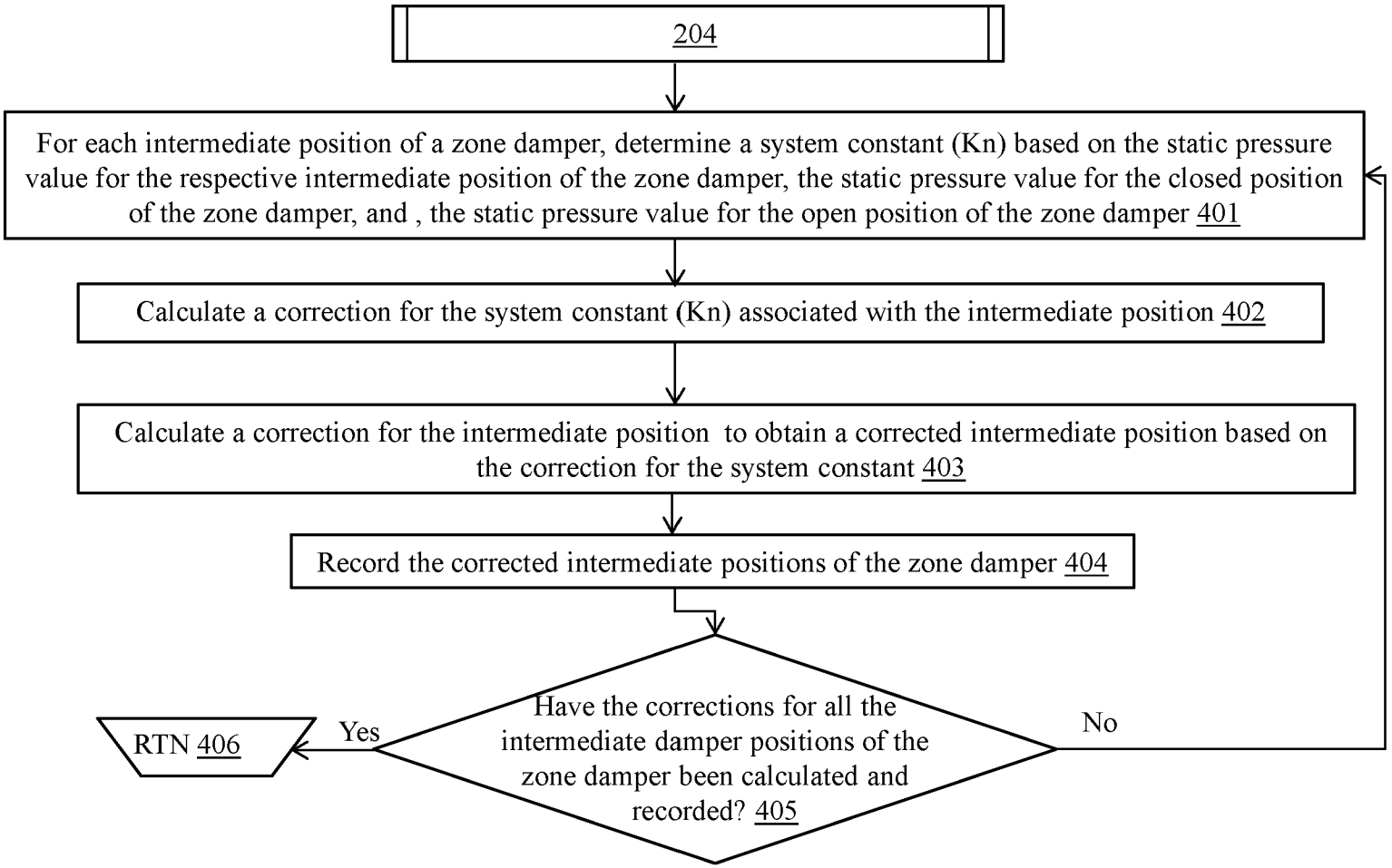
FIG. 4 is a flowchart illustrating an example method of calculating corrected zone damper positions to exhibit a linear behavior of airflow as a function of zone damper position, in accordance with example embodiments of the present disclosure.

Although specific operations are disclosed in the flowcharts illustrated in FIGS. 2-4, such operations are only non-limiting examples. That is, embodiments of the present invention are well suited to performing various other operations or variations of the operations recited in the flowcharts. It is appreciated that the operations in the flowcharts illustrated in FIGS. 2-4 may be performed in an order different than presented, and that not all of the operations in the flowcharts may be performed.

All, or a portion of, the embodiments described by the flowcharts illustrated in FIGS. 2-4 can be implemented using computer-readable and computer-executable instructions which reside, for example, in computer-usable media of a computer system, a memory of the system controller 104, or like device. As described above, certain processes and operations of the present invention are realized, in one embodiment, as a series of instructions (e.g., software programs) that reside within computer readable memory of a computer system or a memory associated with the system controller 104 and are executed by the processor of the computer system or the system controller 104. When executed, the instructions cause the computer system or the system controller 104 to implement the functionality as described below.

Turning to FIG. 2, the operation 200 of the system controller 104 is executed during an initial set up phase of the HVAC system 100. In other words, system controller 104 executes operation 200 shortly after the HVAC system 100 in installed and may or may not be repeated periodically thereafter.

The operation 200 starts at step 201 and proceeds to step 202 where the system controller 104 determines the relative size of each zone of the HVAC system 100. Determining the relative size of each zone allows the system controller 104 to further determine a share of the total system airflow that each zone may receive when the zone dampers of the HVAC system are fully open. Determining the size of each zone, as identified in step 202, will be described below in greater detail in association with FIG. 3.

Turning to FIG. 3, operation 202 associated with determining the size of each zone of the HVAC system 100 begins at step 301 where the system controller 104 turns off the temperature control elements 114 of the HVAC system 100 and opens the zone dampers 102 of all the zones. Then, in operation 302, the system controller 104 instructs the air handler controller 110 to energize the blower assembly 112 and deliver a fixed airflow into the supply ducts and the zones of the HVAC system 100. Responsively, in operation 303, the system controller 104 records a static pressure (SP_open) across the HVAC system 100 based on the motor speed of the motor 116 that controls the fan 118 of the blower assembly 112 when the zone dampers 102 of all the zones are open.

Using the motor speed, the static pressure may be obtained from a table that provides static pressure values for different motor speeds (rpm) and the resulting airflow (cfm) values. The table may be developed and stored in a memory of the system controller 104 at a factory, i.e., prior to installation of the HVAC system 100. For example, the table is developed by subjecting the HVAC system 100 to extensive empirical testing at the factory for determining the static pressure across the HVAC system 100 for different motor speeds (rpm) and the resulting airflow (cfm) values. The process of obtaining the static pressure across the HVAC system 100 allows for operation without sensors, which may be beneficial. However, in other example embodiments, sensors may be used to determine the static pressure during operation 202.

Once the static pressure (SP_open) across the HVAC system 100 is determined when the zone dampers 102 of all the zones are open, in steps 304-307, the system controller 104: (a) closes the zone dampers 102 of all the zones except the zone damper 102 of a first zone, and (b) instructs the air handler controller 110 to deliver the same fixed airflow as before. Responsively, the system controller 104 records a static pressure (SP_zone1) across the HVAC system 100 based on the motor speed of the motor 116 that controls the fan 118 of the blower assembly 112 when all the zone dampers 102 except the zone damper 102 of the first zone is opened. In a similar manner, sequentially, zone dampers 102 for each zone in the HVAC system 100 are opened while all other zone dampers 102 are closed. In each step of said sequence, the air handler controller 110 is instructed to deliver the same fixed airflow, and the resulting static pressure (SP_zone(i)) across the HVAC system 100 is recorded.

Finally, when the static pressure (SP_zone(i)) across the HVAC system 100 for each zone that is open by itself is recorded, in operation 307, the system controller 104 calculates the relative size of each zone of the HVAC system 100 based on the recorded static pressure values, i.e., SP_open and SP_zone(i) by using one or more of the fan laws (e.g., second fan law) and/or derivatives of the fan laws. In other example embodiments, any other appropriate mathematical models that relate the static pressure to a duct size may be used to calculate the relative size of each zone without departing from a broader scope of the present disclosure. One of skill in the art would understand how to configure the system controller 104 to compute the relative zone sizes based on the recorded static pressures using the fan laws or derivatives of the fan laws. Accordingly, the calculation of the relative zone sizes of the HVAC system 100 will not be described here in greater detail for the sake of brevity. Once the relative zone sizes are calculated, the system controller 104 reopens the zone dampers 102 of all the zones in step 308 and returns to step 203 of operation 200.

In some example embodiments, when the static pressure (SP_zone(i)) across the HVAC system 100 for each zone has been recorded, prior to calculating the relative zone sizes and returning to step 203 of operation 200, the system controller 104 may close the zone dampers 102 of all the zones and record a static pressure (SP_closed) across the HVAC system 100 for the same fixed airflow from the blower assembly 112 to detect and determine a size of any leaks in the HVAC system 100.

Referring back to FIG. 2, in operation 203, for each zone, the system controller 104 incrementally closes the zone damper 102 and records a static pressure (SP_position(i)) across the HVAC system 100 for each incrementally closed position of the zone damper 102. Further, once the zone damper 102 of a respective zone reaches a fully closed position, the system controller 104 records a static pressure (SP_zone closed) across the HVAC system 100. Then, the zone damper 102 of the respective zone is opened. Once the static pressure across the HVAC system 100 is recorded for each intermediate position and the closed position of the zone damper, in operation 204, the system controller 104 determines, based on the recorded static pressure values, a correction for each intermediate position of the zone damper to provide a linear behavior of airflow with each change in damper position of the zone damper 102. Determining the correction for each intermediate position of the zone damper 102 will be described below in greater detail in association with FIG. 4.

Turning to FIG. 4, in operation 401, for each intermediate position (hereinafter (position_n) of the zone damper, the system controller 104 calculates a system constant (Kn) based on the recorded values of: (a) the static pressure (SP_position(i)) across the HVAC system 100 when the zone damper is at the respective position_n, (b) the static pressure (SP_zone closed) across the HVAC system 100 when the zone damper is in the closed position, and (c) the static pressure (SP_open) across the HVAC system 100 when the zone damper is the open position. In particular, the system constant (Kn) for the position_n of the zone damper is calculated using a mathematical model comprising the following mathematical equation that is derived from the second fan law:

$$Kn = \frac{\left(1 - \sqrt{\frac{SP_{position(n)}}{SP_{zone\ closed}}}\right)}{\left(1 - \sqrt{\frac{SP_{open}}{SP_{zone\ closed}}}\right)}$$

In other words, in operation 401, the system controller 104 applies the recorded values of the static pressures, i.e., SP_position(n), SP_open, and SP_zone closed to the above included mathematical model to generate the system constant (Kn) value for the position_n of the zone damper 102. As described above, SP_open refers to the static pressure across the HVAC system 100 when all the zones are fully open, SP_position(i) refers to the static pressure across the HVAC system 100 for each incrementally closed position 'i' of a zone damper 102 when the other zone dampers 102 are fully open, and SP_zone closed for a zone refers to the static pressure across the HVAC system 100 when said zone is fully closed while the other zones 102 are fully open.

Responsive to generating the system constant (Kn), in operation 402, the system controller 104 calculates a correction for the system constant (Kn) associated with position_n of the zone damper. In an ideal system with a linear behavior, the value of the system constant (Kn_ideal) for each intermediate position should be equal to a value of the current intermediate position divided by the total number of damper positions of the zone damper. That is, in an ideal system with a linear behavior, $$Kn_ideal = (\text{Damper position_}n)/(\text{Total number of damper positions})$$

However, typically, the system constant (Kn) exhibits a nonlinear behavior. Therefore, the system controller 104 calculates a correction for the system constant (Kn) associated with the position_n of the zone damper 102 based on a value of the system constant (Kn_ideal) associated with the position_n in the ideal system, the value of the system constant (Kn) associated with the position_n which is calculated based on the recorded static pressure values, and the value of the system constant ($K_{n+1}$) associated with the next position of the zone damper following the intermediate position_n which is calculated based on the recorded static pressure values. In particular, the correction for the system constant (Kn) associated with the position_n of the zone damper may be expressed as a percentage value and is calculated using the following mathematical equation:

$$\text{Correction } percent_n = \frac{(Kn_{ideal} - K_{n+1})}{(Kn - K_{n+1})}$$

The correction for the system constant associated with the position_n of the zone damper 102 may adjust for a deviation of the system constant (Kn) from the ideal system constant (Kn_ideal) resulting from the nonlinear behavior. Responsive to calculating the correction for the system constant associated with position_n of the zone damper 102, in operation 403, the system controller 104 calculates a corrected position_n by applying the calculated correction for the system constant (Kn) associated with the position_n of the zone damper. In particular, the corrected position_n corresponding to the position_n of the zone damper is calculated using the following mathematical equation:

$$\text{Corrected damper position}_n = (\text{Damper position}_n - (1 - \text{Correction percent}_n) * (\text{Damper position}_n - \text{Damper position}_{n+i}))$$

At the corrected damper position, the system may exhibit a linear airflow behavior through the zone damper. Responsive to calculating the corrected position_n corresponding to the position_n of the zone damper 102, in operation 404, the system controller 104 records the corrected position_n of the zone damper 102. Further, in operation 405, the system controller 104 determines whether corrected positions for all the damper positions of the zone damper 102 have been calculated and recorded. If the corrected positions for all the damper positions of the zone damper 102 has not been calculated and/or recorded, then, steps 401-404 may be repeated for the remaining damper positions of the zone damper 102 till corresponding corrected positions for all the damper positions of the zone damper 102 has been calculated and recorded. Once the corresponding corrected positions for all the damper positions of the zone damper 102 have been calculated and recorded, the system controller 104 returns to step 205 of operation 200.

Returning to FIG. 2, in operation 205, the system controller 104 checks whether the corrected positions for the intermediate positions of all the zone dampers 102 of the HVAC system 100 have been calculated. If the system controller 104 determines that corrected positions for the intermediate positions all the zone dampers 102 have not been determined, then, step 203-204 may be repeated for the remaining zone dampers 102 of the HVAC system 100 till corrected positions for the intermediate positions of all the zone dampers 102 have been determined.

After the corrected positions for the damper positions of all the zone dampers 102 have been calculated and recorded in the initial set up phase, in operation 206, the system controller 104 may adjust the damper position of a zone damper 102 to the corrected position to deliver a specific airflow to a zone in which the zone damper 102 is disposed responsive to a demand for delivering the specific airflow to the zone. The operation 200 of the system controller 104 ends at step 207.

Operation 206 may be executed during an operational phase of the HVAC system 100 (heating or cooling cycle) to meet a demand for conditioning a zone. For example, during an operational phase of a two-zone HVAC system where 75% of the total airflow may be delivered to the first zone and 25% of the total airflow may be delivered to the second zone, the system controller 104 may determine that the airflow in the first zone has to be reduced to 20% of the normal 75% of the total airflow that is delivered to the first zone. Accordingly, in said example, the system controller 104 may adjust a zone damper 102 associated with the first zone to a corrected intermediate position of the zone damper 102 that delivers 20% of the normal 75% of the total airflow to the first zone. In conventional HVAC systems, responsive to determining that airflow in the first zone has to be reduced to 20%, the system controller 104 adjusts the zone damper 102 of the first zone to be 20% open. However, when the zone damper is 20% open, the airflow to the first zone may be more than or less than the required 20% airflow because of the nonlinear behavior of the airflow with respect to the zone damper positions. In the HVAC system 100 of the present disclosure, to achieve the 20% airflow to the first zone, the zone damper may be adjusted to the corrected position that delivers 20% airflow to the zone. The corrected position may be open more than or less than 20% based on the correction that is calculated for the nonlinear behavior of airflow through the zone damper. For example, 20% airflow may be delivered by opening the zone damper by 30% or 5%. In some example embodiments, the 20% airflow may be delivered by opening the zone damper by 20% if the airflow through the zone damper at the 20% open position exhibits a linear behavior. A linear behavior of the airflow with each change in damper position of the zone dampers allows for a precise knowledge and control of airflow to the zones, which in turn enhances the overall system performance of the HVAC system 100.

Zone sizing may be used to determine how much airflow goes through each zone when the dampers are fully open, and the linearization of the airflow may then be used to precisely adjust percentage of airflow in a specific zone. Even though FIG. 2 illustrates the zone sizing operation, i.e., operation 202 as being performed in conjunction with the damper position correction operation, i.e., operations 203-204, one of ordinary skill in the art can understand that in some example embodiments, operation 202 may be omitted. In said example embodiments where the operation 202 of sizing the zones of the HVAC system is omitted, the static pressure associated with the fully open position of the zone dampers may be recorded as a part of operation 203.

Figure 5:
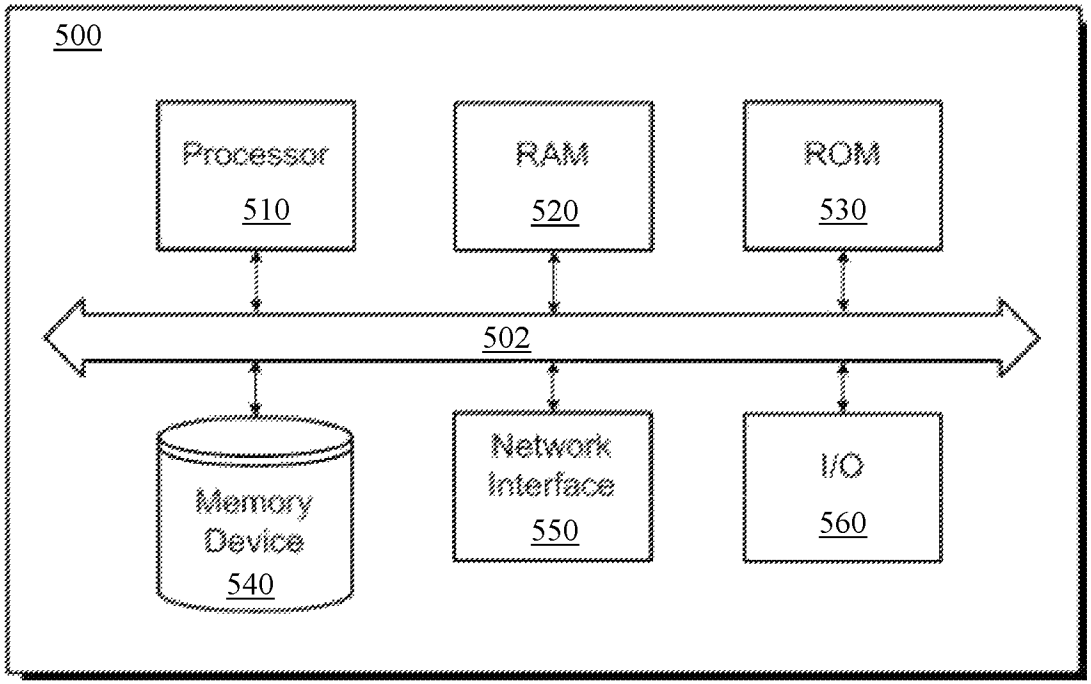
FIG. 5 illustrates a block diagram of an example system controller of the control system of FIG. 1, in accordance with example embodiments of the present disclosure.

Turning to FIG. 5, this figure illustrates an example hardware diagram of an example controller 500. The system controller 104 may be implemented using combinations of one or more of the elements of the example controller 500. The controller 500 includes a processor 510, a Random Access Memory (RAM) 520, a Read Only Memory (ROM) 530, a memory (i.e., storage) device 540, a network interface 550, and an Input Output (I/O) interface 560. The elements of the computer 500 are communicatively coupled via a bus 502.

The processor 510 comprises any well-known general purpose hardware processor. Both the RAM 520 and the ROM 530 comprise well known random access and read only memory devices, respectively, that store computer-readable instructions to be executed by the processor 510. The memory device 540 stores computer-readable instructions thereon that, when executed by the processor 510, direct the processor 510 to execute various aspects of the present invention described herein. As a non-limiting example group, the memory device 540 may comprise one or more of an optical disc, a magnetic disc, a semiconductor memory (i.e., a flash based memory), a magnetic tape memory, a removable memory, combinations thereof, or any other well-known memory means for storing computer-readable instructions. The I/O interface 560 comprises input and output ports, device input and output interfaces such as a keyboard, pointing device, display, communication, and other interfaces. The bus 502 electrically and communicatively couples the processor 510, the RAM 520, the ROM 530, the memory device 540, the network interface 550, and the I/O interface 560, so that data and instructions may be communicated among the processor 510, the RAM 520, the ROM 530, the memory device 540, the network interface 550, and the I/O interface 560. In operation, the processor 510 is configured to retrieve computer-readable instructions stored on the memory device 540, the ROM 530, or another storage means, and copy the computer-readable instructions to the RAM 520 for execution. The processor 510 is further configured to execute the computer-readable instructions to implement various aspects and features of the present invention described herein.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

That which is claimed is:

1. A system comprising:

a fan;

a damper configured to move from a first position to a second position; and a controller configured to:

determine a first static pressure value when the damper is in the first position;

determine a second static pressure value when the damper is in the second position;

determine, based at least in part on a difference between the first static pressure value and the second static pressure value, that airflow through the system is nonlinear;

determine a first corrective positional adjustment for the first position based at least in part on the first static pressure value and the second static pressure value;

determine a third position for the damper using the first corrective positional adjustment; and cause the damper to move to the third position instead of the first position.

2. The system of claim 1, wherein the controller is further configured to:

increment the damper in a first direction by a first amount;

increment the damper in the first direction by a second amount; and determine that airflow through the system is linear;

wherein the first corrective positional adjustment is a sum of the first amount and the second amount.

3. The system of claim 1, wherein the controller is further configured to:

determine a second corrective positional adjustment for the second position based at least in part on the first static pressure value and the second static pressure value;

determine a fourth position for the damper using the second corrective positional adjustment; and cause the damper to move to the fourth position instead of the second position.

4. The system of claim 1, wherein the controller is further configured to:

replace the first position with the third position in memory coupled to the controller.

5. The system of claim 1, wherein the first corrective positional adjustment is determined as a percent value adjustment relative to the first position.

6. The system of claim 1, wherein the controller is further configured to:

determine a system constant value based at least in part on the first static pressure value and the second static pressure value; and determine a system constant correction value using the third position.

7. The system of claim 1, wherein the controller is further configured to:

determine an amount of vibration present during movement of the damper from the first position to the second position; and determine, based at least in part on the amount of vibration, that airflow through the system is nonlinear.

8. The system of claim 1, wherein the controller is further configured to:

determine, after the damper is in the third position, that airflow through the system is linear.

9. The system of claim 1, wherein the damper is configured to direct airflow through a heating, ventilation, and air-conditioning system.

10. A method comprising:

determining, by a controller of an HVAC system having a fan and a damper, a first static pressure value when the damper is in a first position;

determining a second static pressure value when the damper is in a second position;

determining, based at least in part on a difference between the first static pressure value and the second static pressure value, that airflow through the HVAC system is nonlinear;

determining a first corrective positional adjustment for the first position based at least in part on the first static pressure value and the second static pressure value;

determining a third position for the damper using the first corrective positional adjustment; and causing the damper to move to the third position instead of the first position.

11. The method of claim 10, further comprising:

incrementing the damper in a first direction by a first amount; incrementing the damper in the first direction by a second amount; and determining that airflow through the system is linear;

wherein the first corrective positional adjustment is a sum of the first amount and the second amount.

12. The method of claim 10, further comprising:

determining a second corrective positional adjustment for the second position based at least in part on the first static pressure value and the second static pressure value;

determining a fourth position for the damper using the second corrective positional adjustment; and causing the damper to move to the fourth position instead of the second position.

13. The method of claim 10, further comprising:

replacing the first position with the third position in memory coupled to the controller.

14. The method of claim 10, wherein the first corrective positional adjustment is determined as a percent value adjustment relative to the first position.

15. The method of claim 10, further comprising:

determining a system constant value based at least in part on the first static pressure value and the second static pressure value; and determining a system constant correction value using the third position.

16. The method of claim 10, further comprising:

determining an amount of vibration present during movement of the damper from the first position to the second position; and determining, based at least in part on the amount of vibration, that airflow through the system is nonlinear.

17. The method of claim 10, further comprising:

determining, after the damper is in the third position, that airflow through the system is linear.

18. The method of claim 10, wherein the damper is configured to direct airflow through a heating, ventilation, and air-conditioning system.

* * * * *